United States Patent [19]

Keefer

[11] Patent Number: 4,879,775

[45] Date of Patent: Nov. 14, 1989

[54] REINFORCED RAIL ASSEMBLY FOR WATERBEDS

[75] Inventor: Donald W. Keefer, Pasadena, Md.

[73] Assignee: Classic Corporation, Jessup, Md.

[21] Appl. No.: 185,006

[22] Filed: Apr. 22, 1988

Related U.S. Application Data

[63] Continuation-in-part of Ser. No. 70,125, Jul. 6, 1987, Pat. No. 4,771,491, which is a continuation of Ser. No. 906,610, Sep. 10, 1986, abandoned, which is a continuation of Ser. No. 775,015, Sep. 11, 1985, abandoned.

[51] Int. Cl.[4] ..... A47C 19/00; A47C 27/08

[52] U.S. Cl. ..... 5/400; 5/451

[58] Field of Search ..... 5/400, 401, 451, 452, 5/460, 474

[56] References Cited

U.S. PATENT DOCUMENTS

| | | | |
|---|---|---|---|
| 4,389,741 | 6/1983 | Larson | 5/400 |
| 4,651,368 | 3/1987 | Santo | 5/451 |
| 4,771,491 | 9/1988 | Fogel et al. | 5/400 |

*Primary Examiner*—Richard E. Chilcot, Jr.

*Attorney, Agent, or Firm*—Finnegan, Henderson, Farabow, Garrett & Dunner

[57] ABSTRACT

A rail assembly is provided for forming reinforced waterbed walls. The rail assembly when assembled includes a plurality of cushions for defining the outer walls of a waterbed. Each cushion has an inner, a top and a bottom face. A reinforcing bar is positioned adjacent each cushion. Each reinforcing bar includes first, second and third members. The first member extends from the inner face of the cushion into the cushion. The second member extends from the first member along the inner face of the cushion. The third member extends from the second member away from the cushion and is oriented substantially coplanar with the bottom face of the cushion. The third member has overlapping areas and hook and pile fastening material, positioned between the overlapping areas to interlock the third members together. Additional hook and pile fastening material is positioned on the third member to fasten the third member to a fabric shell which surrounds and encloses the rail assembly.

9 Claims, 2 Drawing Sheets

FIG. 3
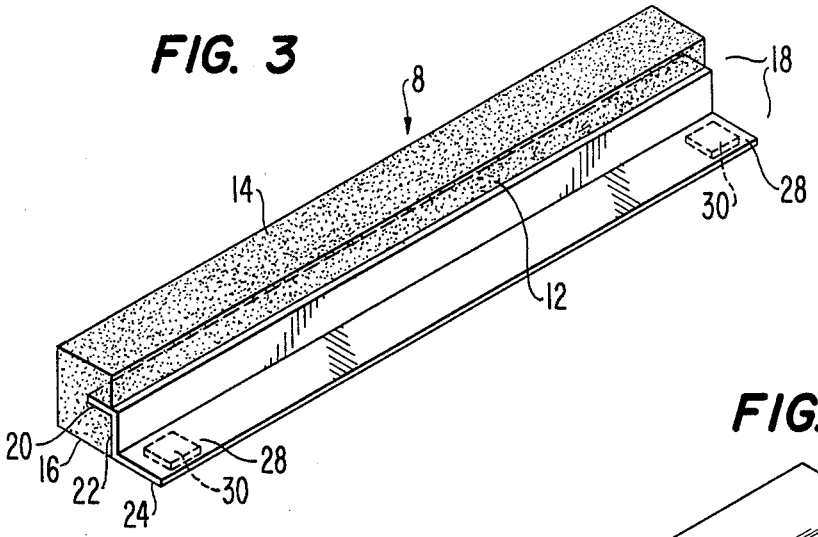
FIG. 5
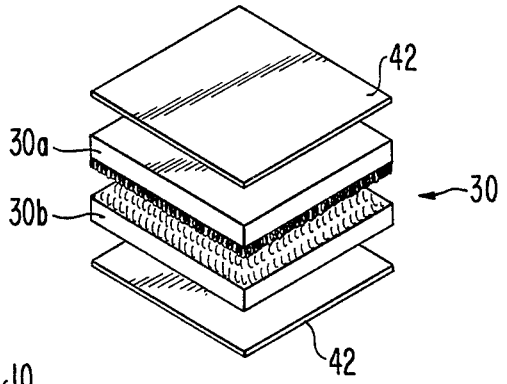
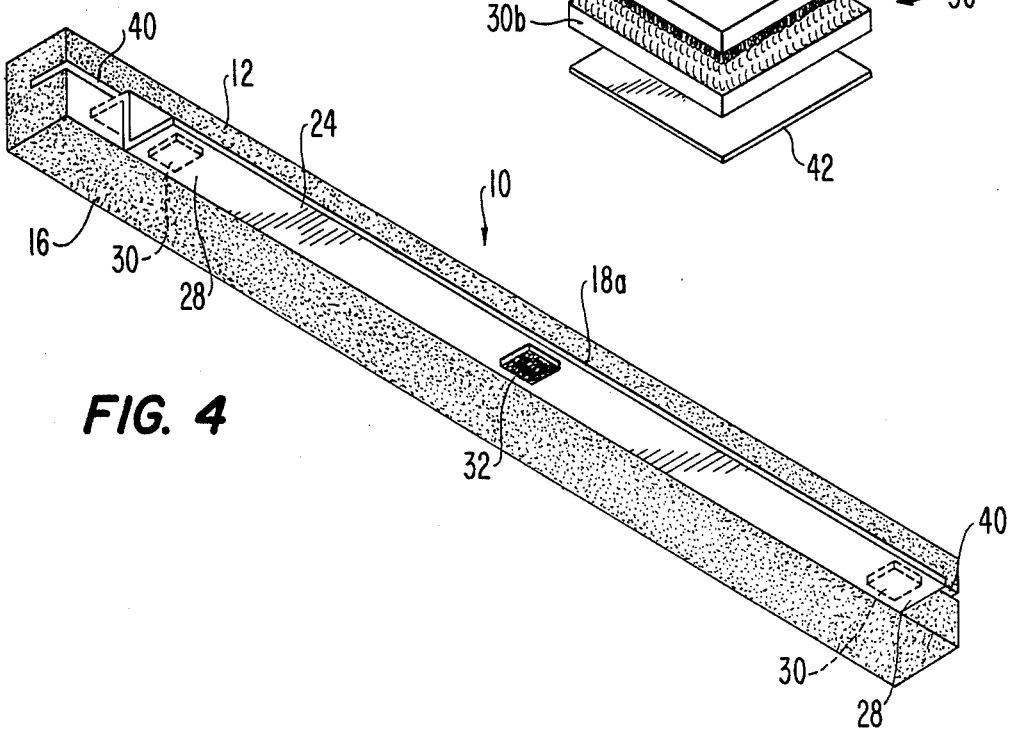
FIG. 4

REINFORCED RAIL ASSEMBLY FOR WATERBEDS

RELATED APPLICATIONS

The present patent application is a continuation-in-part of patent application Ser. No. 070,125 filed July 6, 1987, now U.S. Pat. No. 4,771,491, which is a continuation of patent application Ser. No. 906,610 filed Sept. 10, 1986, now abandoned, which is a continuation of patent application Ser. No. 775,015 filed Sept. 11, 1985, now abandoned, which are incorporated herein.

BACKGROUND OF THE INVENTION

The present invention relates to a waterbed with a reinforced rail assembly.

In recent years, beds which utilize fluid-filled mattresses, commonly known as waterbeds, have become popular. Waterbeds have evolved from relatively simple arrangements consisting of water-filled bladders supported and confined by bulky, hard, peripheral support frames to waterbed mattresses and foundation combinations having the same general size and appearance as a conventional innerspring mattress and foundation set. These arrangements are desirable because they are pleasant in appearance and use, and may employ standard bed clothes such as mattress covers and fitted sheets.

One such waterbed is known as the soft-sided or hybrid system. Traditionally, however, soft-sided waterbeds have been manufactured as a unitary structure. As a result, waterbed manufacturers have experienced a hardship in economically distributing their product. This is because, in contrast with the conventional innerspring of foam mattress manufacturers, waterbed manufacturers generally do not operate multiple plants which service a relatively small regional areas. Rather, they tend to operate one or two plants which destribute on a national basis. Consequently, because of the freight cost, the importance of compact readily shippable systems has dominated design considerations in soft-side or hybrid systems. The conventional response to this dilemma has manifested itself in various "readyto-assemble" systems which, for the most part, are deep fill units (i.e., 8" to 12" water depth).

Because of the construction of a "well" type structure on these foundations, it is far simpler to develop designs for the "ready-to-assemble" upper cavity which depend on the walls of the "well" to locate and assist in retaining the assembled top cavity. Virtually all such designs require hardware (i.e, nuts, bolts, wing-nuts, etc.) to assemble, thus necessitating tools. The difficulty with this conventional response is that missing hardware, stripped threads, burred screw or bolt heads may frequently puncture the vinyl water mattress, etc. Furthermore, many of the traditional soft-sided systems have to be shipped with the cavity assembled which increased bulk, thereby increasing the transportation costs.

There have been difficulties in the industry in manufacturing a compact, economically shipped, simple, tool-free assembly, "ready-to-assemble" hybrid system designed for the increasingly popular low fill type system (i.e., tube systems, 3½" to 6" fill). Such difficulties are illustrated in considering the approaches conventionally used in soft-side waterbeds.

A first approach has been to construct systems having an 8" or greater fill depth. In this fashion, the foundation unit could be constructed with a "well" type of wall structure about the perimeter. This permitted a top cavity to be located atop the perimeter wall with reinforcements. Alternately, a part of the top cavity wall could extend down into the "well" or inside of the foundation perimeter wall. It appeared that this solved the problem of constructing a soft-side waterbed which would structurally inhibit bowing of the side wall. However, two problems remain unanswered by this approach. First, this did not answer the bowing potential in low fill (6" or less) systems. Second, it did not, in all cases, provide for a compact, economically shipped and easily assembled unit. Further, waterbeds which required hardware for assembly still had the problems missing hardware, and burred hardware which could damage other components.

A second approach has been to construct a low fill (6" or less) soft-sided waterbed structure. In such systems, either a rigid deck or a flexible foam pad, serve as the unifying component to which all other structural components are fastened. The difficulty, however, with such structures is that they necessitate shipping in a fully assembled state, thus not resolving the problem of bulk and higher freight costs.

A third approach has been to construct a cross-over type soft-sided system that requires installation in a shorter walled hard-sided type system or a molded hard-sided type structure. These structures are not truly soft-sided systems and did not satisfactorily resolve the problem.

A fourth approach has been to reinforce the wall structure of the top cavity of the waterbed. Though this approach somewhat prevents bowing, the presence of reinforcing members can create problems when using the bed. In some cases, the placement and position of reinforcing members results in penetration into the foam cushioning such that it is "cut" into. In addition, this approach causes an uncomfortable, "boardy" feeling. Further, such reinforcements significantly decrease the overall durability of the waterbed systems.

SUMMARY OF THE INVENTION

An object of the present invention is to provide a waterbed assembly which breaks down into a shipping package which is significantly smaller in volume than a fully assembled system and which assembles with ease and without the need for tools or hardware.

It is another object of the present invention to provide a reinforcement system prevents bowing of the waterbed, which is unobtrusive and which cannot cut into the foam or otherwise shorten the life of the system.

It is another object of the present invention is to provide a modest costing reinforced wall soft-sided waterbed having superior durability.

A further object of the present invention is to provide a reinforced wall soft-sided waterbed having an attractive appearance and a comfortable sleeping surface.

To achieve the foregoing objects, and in accordance with the purposes of the invention, there is provided a rail assembly for forming reinforced waterbed walls. The rail assembly includes a plurality of cushions for defining the outer walls of a waterbed when assembled. Each cushion has an inner, a top and a bottom face. A reinforcing bar is positioned adjacent each cushion. Each reinforcing bar includes first, second and third members. The first member extends from the inner face of the cushion into the cushion. The second member extends from the first member along the inner face of the cushion. The third member extends from the second member away from the cushion and is oriented substantially coplanar with the bottom face of the cushion.

It is preferable to provide means for interlocking together portions of the third members. It is also preferable that the means for interlocking include overlapping areas of adjacent third members and hook and pile fastening material positioned between the overlapping areas of the third members. It is also preferable that additional hook and pile fastening material is positioned on the third member as a means for fastening such to a fabric shell which surrounds and encloses the rail assembly.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

FIG. 3 shows a perspective view from above of one of the rails shown in FIG. 1;

FIG. 4 shows a perspective view from below of another one of the rails shown in FIG. 1; and, FIG. 5 shows an exploded perspective view of the hook and pile fastening material shown in FIGS. 2–4.

DESCRIPTION OF THE PREFERRED EMBODIMENT

Reference will now be made in detail to the present preferred embodiment of the invention as illustrated in the accompanying drawings.

Figure 1:
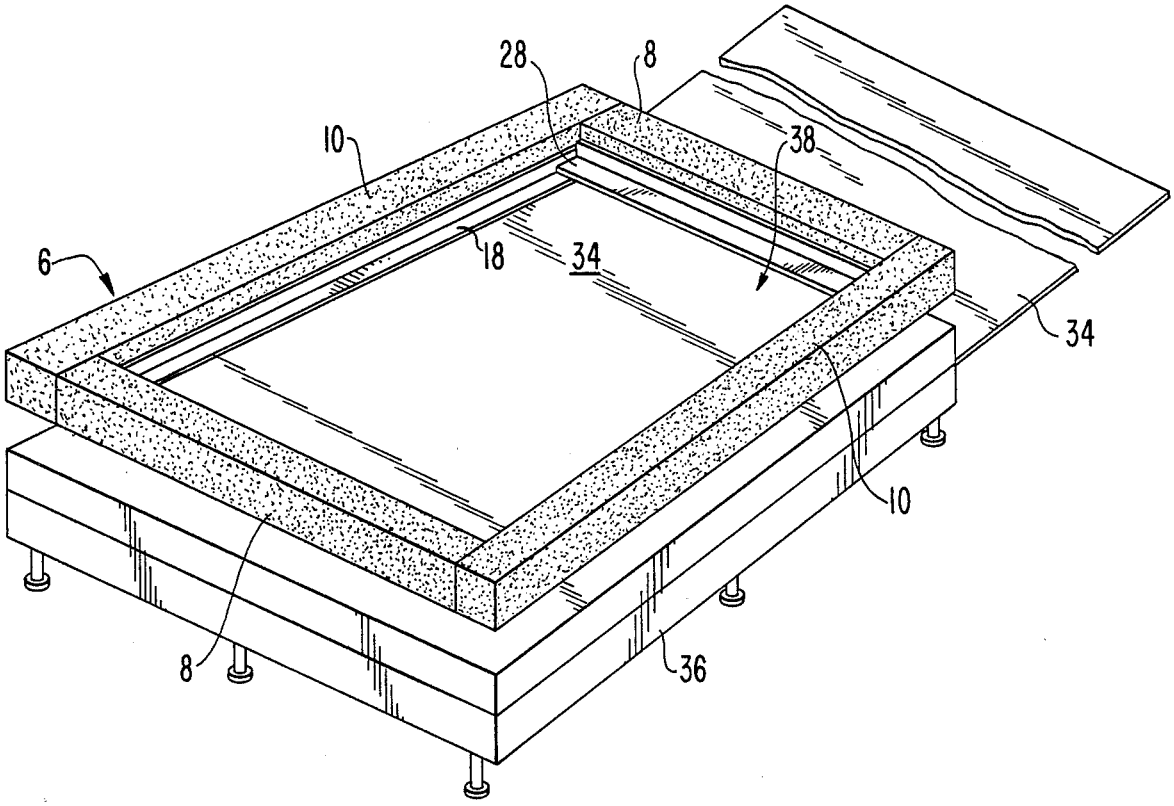
FIG. 1 shows a perspective view of the rail assembly and pedestal according to the present invention.
Figure 2:
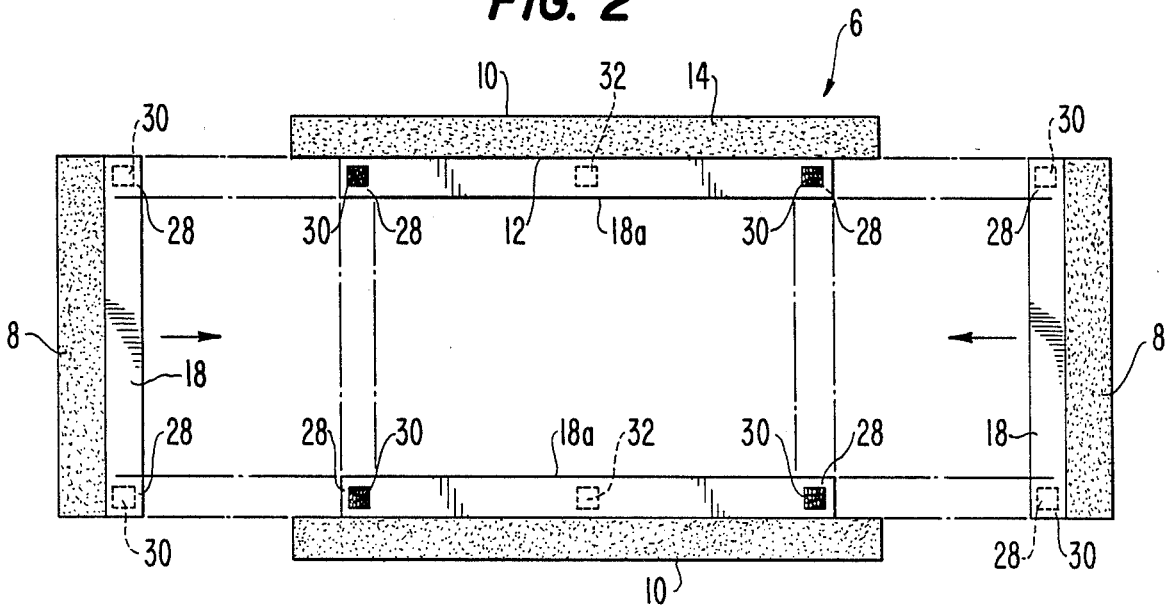
FIG. 2 shows an exploded plan view of the rail assembly shown in FIG. 1.

In accordance with the present invention there is provided a rail assembly for forming reinforced waterbed walls. As shown in FIGS. 1 and 2, the rail assembly is generally designed by reference numeral 6.

In accordance with the present invention the rail assembly includes a plurality of cushions for defining the outer walls of a waterbed when assembled. Each cushion has an inner face, a top face and a bottom face. As shown in FIGS. 1 and 2, the plurality of cushions includes two end cushions 8 and two side cushions 10 which, when assembled, form a substantially rectangular rail assembly. As shown in FIGS. 3 and 4, each of the cushions 8 and 10 include an inner face 12, a top face 14, and a bottom face 16. Cushions 8 and 10 are made of a rectangular block of urethane foam which includes a horizontal slit 40 in inner face 12.

In accordance with the present invention there is provided a reinforcing bar positioned adjacent each cushion which has first, second and third members, the first member extends into the cushion from its inner face at a position intermediate the top and bottom surfaces, the second member extends from the first member along the inner face and the third member extends from the second member away from the cushion and is oriented substantially coplanar with the bottom face.

As shown in FIGS. 1–4, the reinforcing bars are generally designated by reference numerals 18 and **18*a* and are positioned adajcent end cushions 8 and side cushions 10, respectively. As shown in FIG. 3, reinforcing bars 18 and 18*a* have a horizontally extending first member 20, a vertically extending second member 22, and a horizontally extending third member 24. These members are made of high impact polystyrene and form an integral structure. Reinforcing bars 18 and 18*a* enhance the structural integrity of the rail assembly 6 by adding rigidity to the flexible urethane foam cushions, and by interlocking overlapping areas 28 of adjacent third members 24. Reinforcing bars 18 run the full length of the end cushions 8. Reinforcing bars 18*a* are shorter than the side cushions 10. As shown in FIG. 4, the first member 20 is inserted into and is adhesively bonded to horizontal slit 40 in the inner face 12 of each end cushion 8 and side cushion 10**.

In accordance with the present invention there is provided a means for interlocking together portions of the third members 24. As shown in FIGS. 1 and 4, the means for interlocking together portions includes overlapping areas 28 of adjacent third members 24 and hook and pile fastening material 30.

As shown in FIG. 5, fastening material 30 includes mating pieces of material such as Velcro, with hook piece 30b and pile piece 30a, having pressure-sensitive adhesive on reverse sides of the hook and pile pieces. Fastening material 30 is placed at the location of the overlapping portions 28 and the pressure adhesive portions are attached to the bottom face of the third member 24, of the two end cushions 8, in the overlapping portions 28, and are also attached to top face of the third member 24, of the two side cushions 10, in the overlapping portions 28.

As shown in FIG. 5, a protective release paper cover 42 is initially included on top and bottom faces of the hook piece 30b and pile piece **30*a* material 30, respectively, and remains in place for packing and shipping. To construct the rail assembly 6, the two side cushions 10 and the two end cushions 8 are aligned on the inside bottom of the fabric shell 34. The release paper cover 42 is removed from one face of the hook and pile material 30 and the hook and pile material is attached to the third members 24. The protective release paper 42 is removed from the other face of the fastening material 30 and the reinforcing bars 18 and 18*a* are pressed firmly into place so that each half of the mated hook and pile fastening material 30 is affixed to the third member 24 of adjacent reinforcing bars 18 and 18a**. The use of a hook and pile fastening material allows for releasable attachment for disassembling and reassembling the rails.

In accordance with the present invention there is provided a means for fastening the third members to a fabric shell 34. As shown in FIG. 4, the fastening means includes hook and pile fastening material 32 which fastens the third members 24 to a fabric shell 34 which surrounds and encloses the rail assembly 6 and the waterbed bladder. The hook and pile fastening material 32 is placed on the bottom face of, and approximately intermediate at least one of the third members 24 of the plurality of cushions. The protective release paper cover 42 of the hook and pile fastening material 32 is removed from one face of the hook and pile material, secured to the bottom of third member 24, the protective release paper cover 42 from the other face is removed, and the rail assembly is firmly placed atop the bottom of the fabric shell 34.

FIG. 1 shows a perspective view of the rail assembly 6 which forms an opening 38 into which a fluid filled bladder, a plurality of water filled tubes, or the like is then placed to form the waterbed. The rail assembly 6 is surrounded and enclosed by a fabric shell 34 and looks like a conventional innerspring mattress. Although the embodiment shown uses rectilinear shaped rails, it is also possible to use rails of other shapes such as ones with sloped inner faces. This assembly is supported by a foundation 36 having a flat rigid top surface. Foundation 36 has the shape and dimensions of a conventional mattress boxspring and is upholstered to give such an appearance.

Additional advantages and modifications will readily occur to those skilled in the art. The invention and its broader aspects are, therefore, not limited to the specific details, representative apparatus and illustrative examples shown and described. Accordingly, departures may be made from such details wihtout departing from the spirit or scope of applicant's general inventive concept.

What is claimed is:

1. An assembly forming reinforced waterbed walls comprising:

a plurality of cushions defining outer walls of a waterbed when assembled, each cushion having an inner face, a top face and a bottom face; and a reinforcing bar positioned adjacent each cushion, each reinforcing bar having first, second and third members, said first member extending into said cushion from said inner face at a position intermediate said top and bottom faces, said second member extending from said first member along said inner face, and said third member extending from said second member away from said cushion and oriented substantially coplanar with said bottom face.

2. The assembly of claim 1 including means for interlocking together said third members.

3. The assembly of claim 2 wherein the means for interlocking includes overlapping areas of adjacent third members.

4. The assembly of claim 3 wherein said interlocking means includes hook and pile fastening material positioned between said overlapping areas of said third members.

5. The assembly of claim 4 including hook and pile fastening material positioned on said third member for fastening said third member to a shell which surrounds and encloses said rail assembly.

6. The assembly of claim 1 including a fabric shell surrounding and enclosing the cushions and reinforcing bars, the fabric shell having a bottom portion substantially juxtaposed to the bottom face of the cushions and the third members.

7. The assembly of claim 1 including a fabric shell surrounding and enclosing the cushions and reinforcing bars, the fabric shell having a bottom portion oriented substantially coplanar with the bottom face of the cushions and the third members.

8. The assembly of claim 1 wherein the second member is oriented substantially coplanar with the inner face of the cushion.

9. The assembly of claim 1 wherein the second member is substantially juxtaposed to the inner face of the cushion.

* * * * *